United States Patent [19]

Crabtree et al.

[11] Patent Number: 4,947,985

[45] Date of Patent: Aug. 14, 1990

[54] CHEESE SAMPLING TRAY

[75] Inventors: Donald L. Crabtree, Plano, Tex.; Sandra L. Natoli, Mason, Ohio

[73] Assignee: Bongrain International (American) Corporation, Mountainside, N.J.

[21] Appl. No.: 478,750

[22] Filed: Feb. 12, 1990

Related U.S. Application Data

[63] Continuation of Ser. No. 295,062, Jan. 3, 1989, abandoned.

[51] Int. Cl.[5] ..... B65D 5/46; B65D 5/64

[52] U.S. Cl. ..... 206/44.12; 40/312; 206/45.28; 206/45.34; 229/160.2; 229/162; 229/167

[58] Field of Search ..... 40/312; 229/160.2, 122

[56] References Cited

U.S. PATENT DOCUMENTS

| | | | |
|---|---|---|---|
| D. 108,606 | 2/1938 | Nagle | 206/45.34 |
| 2,717,073 | 9/1955 | Young | 206/45.34 |
| 2,722,361 | 11/1955 | Kindseth | 206/45.33 |
| 2,741,414 | 4/1956 | Nottage | 206/525 |
| 3,254,758 | 6/1966 | Guyer | 206/45.33 |

FOREIGN PATENT DOCUMENTS

| | | | |
|---|---|---|---|
| 0722680 | 3/1932 | France | 206/45.31 |
| 0802806 | 9/1936 | France | 206/45.31 |
| 1158190 | 6/1958 | France | 229/165 |
| 2233244 | 1/1975 | France | 206/45.31 |
| 0315241 | 9/1965 | Sweden | 206/45.3 |

*Primary Examiner*—Jimmy G. Foster

*Attorney, Agent, or Firm*—Body, Vickers & Daniels

[57] ABSTRACT

A food display and serving container is provided which display a perishable food, such as cheese, in a visible and easily accessible manner over a long period of time while still preserving freshness. A three side transparent cover fits over a rectangular tray and is adapted to slide transversely across the top of the tray.

10 Claims, 3 Drawing Sheets

CHEESE SAMPLING TRAY

This is a continuation of Ser. No. 295,062 filed Jan. 3, 1989, now abandoned.

The present invention pertains to the art of food packaging, and particularly to the packaging of a food article, such as cheese, which is commonly served to a number of persons in divided portions of the whole. The invention will be described with reference to a cheese sampling tray, although it will be understood that the invention has broader applications including use with other types of foods.

BACKGROUND OF THE INVENTION

A quantity of cheese in a wheel or other formed shape is commonly served simultaneously to a group of persons. This may occur at a social gathering such as a cocktail party or a banquet where guests are invited to help themselves to individual servings of cheese from a relatively large quantity set forth for the entire group, or where gourmet food shops, delicatessens or be like offer samples to customers. The usual method of serving cheese in such settings is to display the cheese on a platter, tray, or even the cutting board upon which the wheel of cheese is sliced into individual servings by the host.

Such conventional methods of serving cheese have several disadvantages. Cheese exposed to the open air may quickly become stale and unappetizing. However, it is extremely inconvenient and impractical, if not inappropriate, to keep open trays of food effectively protected with sheets of foil or other food covering material when the purpose of presenting the food on an open tray is to make it readily available to guests over a period of perhaps several hours. This is particularly important in commercial settings wherein customers may not initially expect to sample the cheese, and thus would not be inclined to remove a covering upon their own initiative. Retention of freshness is also more important in a commercial setting for the obvious reason that the cheese samples are offered not merely as a courtesy but as an inducement for sales. There thus arises the need for a cheese serving appliance which will both retain freshness of the cheese over a long period of time and present the cheese in a clearly visible and readily accessible manner.

Another disadvantage associated with conventional methods of serving cheese to a gathered group of persons is caused by the fact that not all of the individual portions of the wheel of cheese can always be expected to be consumed. Those sample portions remaining on the platter must be properly placed in storage or wastefully disposed of. Again, this is a particular problem for proprietors of commercial establishments who naturally would prefer to avoid the labor involved in transferring the remaining cheese samples to a proper storage container, as well as the damage to the product which is likely to occur upon repeated handling, especially if carelessly attended to by an employee hastily closing up shop.

SUMMARY OF THE INVENTION

The present invention overcomes the above described disadvantages and others and provides a food display and serving appliance which enables a food such as cheese to be visibly presented to a group of people in an appetizing and readily accessible manner, and which also serves as a storage container for the cheese.

In accordance with a principal feature of the invention, there is provided a food display and serving appliance which includes a tray having a rectangular base panel and four upwardly extending peripheral panels including a front panel, a rear panel, and two opposite side panels. A transparent cover is closely receivable over the tray and has three downwardly extending cover walls including a front cover wall and two opposite side cover walls. The invention thus provides a display and serving appliance for a wheel of cheese or the like which maintains freshness of the cheese while displaying it visibly through the transparent cover, and which also provides ready access to the cheese as well as convenience in replacing the cover. These advantageous features of the cover are provided by the three-walled configuration whereby the cover may easily slide laterally back and forth between the front and rear walls of the tray in addition to being lifted vertically off of the tray. This is in contrast to a conventional cover for a box or other container which has four walls corresponding to those of the container, and thus can only be removed by vertical movement, and which cannot conveniently be replaced since the cover walls and the container walls must first be aligned before the cover can be seated upon the container. The invention thus advantageously assures that guests, customers, or others not particularly concerned with maintaining freshness of the cheese will return the cover to its proper position. Furthermore, the invention serves both as a display and storage container for the cheese whereby remaining samples left in the tray needn't be removed therefrom for proper storage.

In accordance with more specific features of the invention, the cover walls are substantially coextensive with the associated tray panels so that the cover will be securely seated upon the tray. The cover is preferred to be formed of a clear plastic material and may include a clear plastic tab adhesively fixed to the top wall at a position adjacent the front cover wall in order to facilitate movement of the cover laterally across the front tray panel. An upwardly open recess may be provided in the front tray panel in order to provide access into the tray for a spatula as well as to clearly indicate which side of the tray is be front so that the cover will consistently be removed and replaced in the preferred orientation.

In accordance with another specific feature of the invention, there is provided a rectangular food support panel substantially coextensive with the rectangular base panel of the tray and loosely receivable within the tray upon the base panel. The food support panel provides a replaceable and disposable surface upon which a wheel of cheese may be placed such that the base panel of the tray can remain clean whereby the tray and cover may be re-used.

Yet another specific feature of the invention is a display panel which is equipped with tabs adapted to be received in slots provided in the rear panel of the tray. The display panel may bear advertising or other printed or graphic matter appropriate for a commercial setting, and further may be used as a food support panel much the same as the food support panel described above. Mounting of the display panel at the rear panel of the tray, in combination with the upwardly open recess in the front tray panel, contributes to the overall appearance of the food display and serving appliance whereby the front and rear sides thereof are readily distinguishable. This assures that persons invited to help themselves to servings of cheese within the container will have little difficulty or reluctance in properly removing and replacing the cover with the appropriate sliding motion laterally across the front panel of the tray. Cheese contained in the container is thus more likely to remain fresh over extended periods of time throughout repeated removals of individuals servings.

In accordance with another principal feature of the invention there is provided a combined food display and serving appliance comprising a cardboard blank form adapted to be folded into a tray, and a transparent plastic cover adapted to be received over the folded tray. The cardboard blank form includes a rectangular base panel having a front edge, a rear edge, and two opposite side edges. The rectangular base panel also includes first slot means associated with the front edge and second slot means associated with the rear edge. A pair of opposing elongated rectangular side panels are connected to the base panel at a corresponding pair of pivotal folding lines at the two opposite side edges of the base panel. A flap member is connected to each longitudinal end of each of the rectangular side panels at a pivotal folding line at each longitudinal end. An elongated rectangular front panel is connected to the base panel at a pivotal folding line along the front edge of the base panel, and is bisected by a pair of longitudinally extending internal folding lines. Tab means are provided at the free longitudinal edge of the front panel and are adapted to register with the first slot means associated with the front edge of the base panel. A rectangular rear panel is similarly provided along the rear edge of the base panel and likewise has tabs adapted to register with the second slot means associated with the rear edge of the base panel. A transparent plastic cover member is provided with a rectangular top wall substantially coextensive with the base panel of the cardboard blank form, and further has a rectangular cover walls consisting of a front cover wall and two opposite side cover walls. The invention thus provides a blank form which can be constructed into a rectangular tray by folding each of the front and rear panels about the associated internal folding lines in order to bring the tabs into engagement with the associated slots in the base panel. The front and rear panels of the tray are thus erected perpendicularly to the base panel. The side panels of the blank form are pivoted about the side edges of the base panel into positions perpendicular thereto, and the flap members at each longitudinal end of a side panel are inserted into the space between the folded over halves of each of the front and rear panel members. The blank form thus erected is a rectangular tray having four rectangular side panels. The transparent cover member can thus be placed upon and removed from the tray by means of a sliding action transversely across the front panel of the tray, as the cover member includes only a front wall and two opposite side walls.

In accordance with a more specific feature of the invention the internal folding line in the front panel is interrupted by a longitudinally elongated, generally rectangular void in the front panel, the void providing an upwardly open recess in the front panel when that panel is erected as described above.

In accordance with another specific feature of the invention the internal folding lines at the rear panel of the tray are interrupted by slot means extending through the cardboard material, the slot means being adapted to register with tab means on a display panel mounted upon the erected tray.

The principal object of the present invention is to provide a food display and serving appliance which conveniently and effectively enables the display and serving of a quantity of food, such as cheese, which is expected to be consumed in successive portions divided from the whole.

Another object of the invention is to provide a food display and serving appliance which displays the food visibly and yet retains freshness thereof over a relatively prolonged period of tire.

Another object of the invention is to provide a food display and serving appliance which provides convenient access to the food for successive removal of divided portions thereof.

Another object of the invention is to provide an appliance which serves as both a food display and serving appliance and as a food storage appliance.

A further object of the present invention is to provide a paperboard blank form which is readily and easily foldable into a rectangular tray, and a plastic cover member for the tray which is adapted for convenient access to a food article contained in the tray.

DESCRIPTION OF A PREFERRED EMBODIMENT

Figure 1:
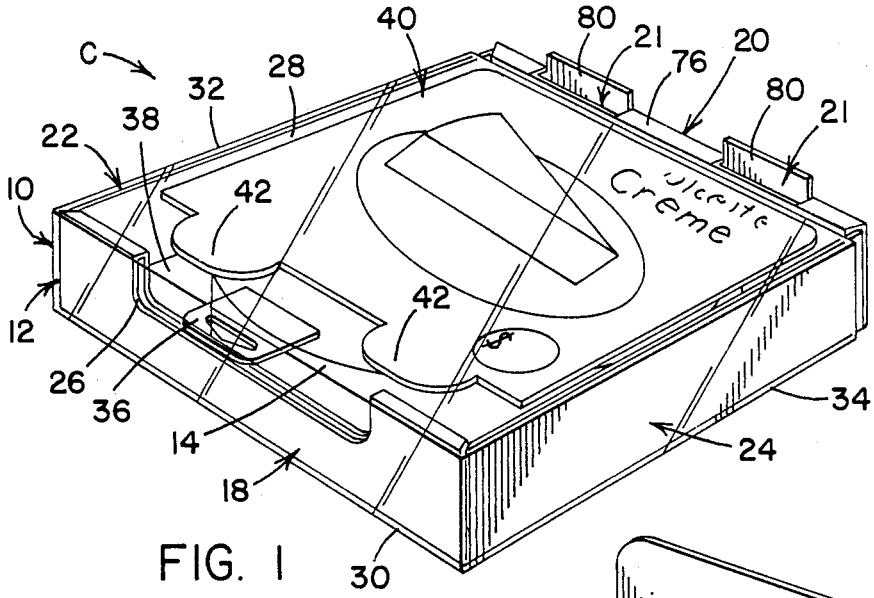
In FIG. 1 there is shown a perspective view of a food display and serving appliance in accordance with the present invention.

Referring now to the drawings wherein the showings are for the purpose of illustrating a preferred embodiment of the invention and not for the purpose of limiting same, in FIG. 1 there is shown in perspective view a food display and serving container constructed in accordance with the present invention. The container C is comprised generally of a rectangular tray 10 and a plastic cover 12, and is shown to contain a wheel of cheese 14, although it is understood that the invention is equally applicable to other types of food products which are served in individual portions taken directly from the whole and which tend to be perishable in a relatively short time.

The rectangular tray 10 comprises a rectangular base panel 16, a front panel 18, a rear panel 20, and two opposite side panels 22 and 24. The front panel 18 includes an upwardly open recess 26 adapted to permit passage of a persons hand, a spatula, or the like, into the rectangular tray 10 in a direction laterally across the front panel 18.

Figure 2:
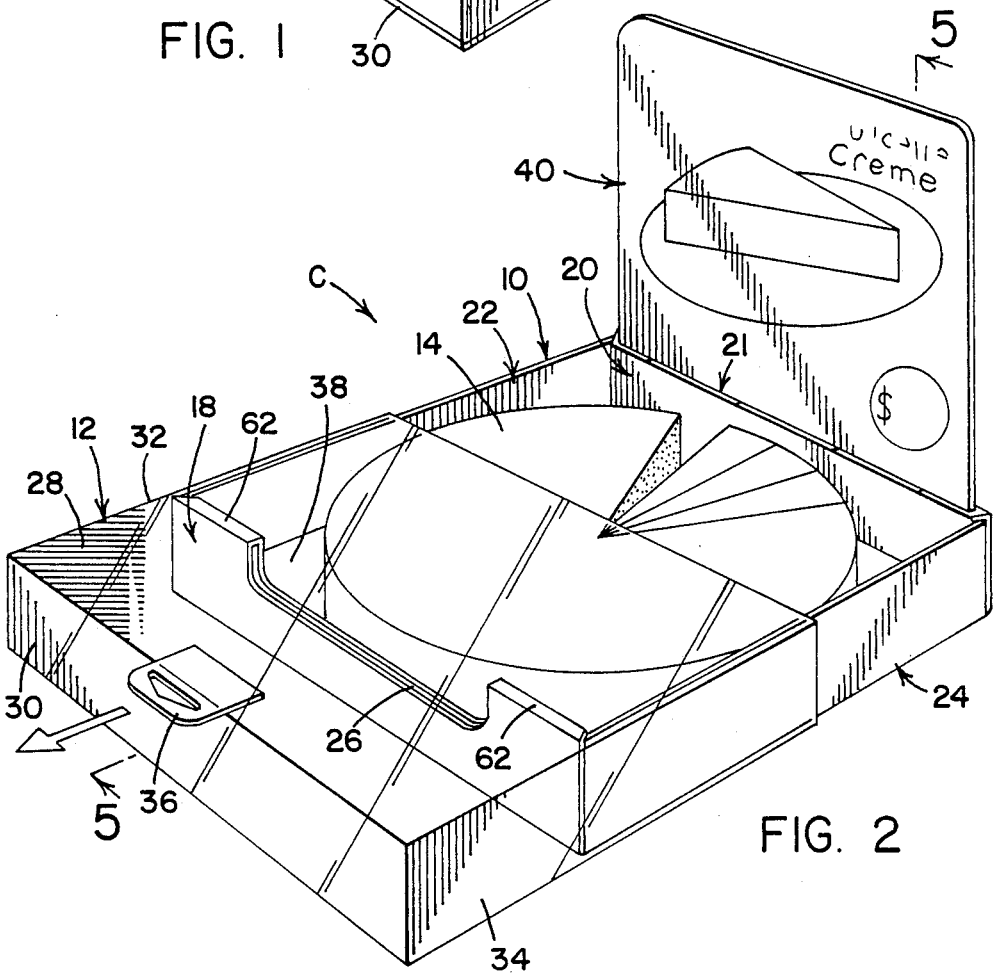
In FIG. 2 there is shown a perspective view of the food display and serving appliance shown in FIG. 1 as arranged in use.

The plastic cover 12 includes a top wall 28, a front wall 30, and two opposite side walls 32 and 34. The front wall 30 and the two opposite side walls 32 and 34 of the plastic cover 12 correspond in size respectively to the front panel 18 and the two opposite side panels 22 and 24 of the tray 10, such that the plastic cover 12 is closely receivable over the tray 10 as shown in FIGS. 1 and 2. The plastic cover 12 further includes a plastic tab handle 36 disposed at a position on the top wall 28 adjacent the front wall 30.

The wheel of cheese 14 sets upon a food support panel 38. Also shown within the container C in FIG. 1 is a display panel 40 bearing illustrations and text appropriate to the particular food product, and including tabs 42 adapted to register with the slots 21 in the rear panel 20 of the tray 10.

Figure 6:
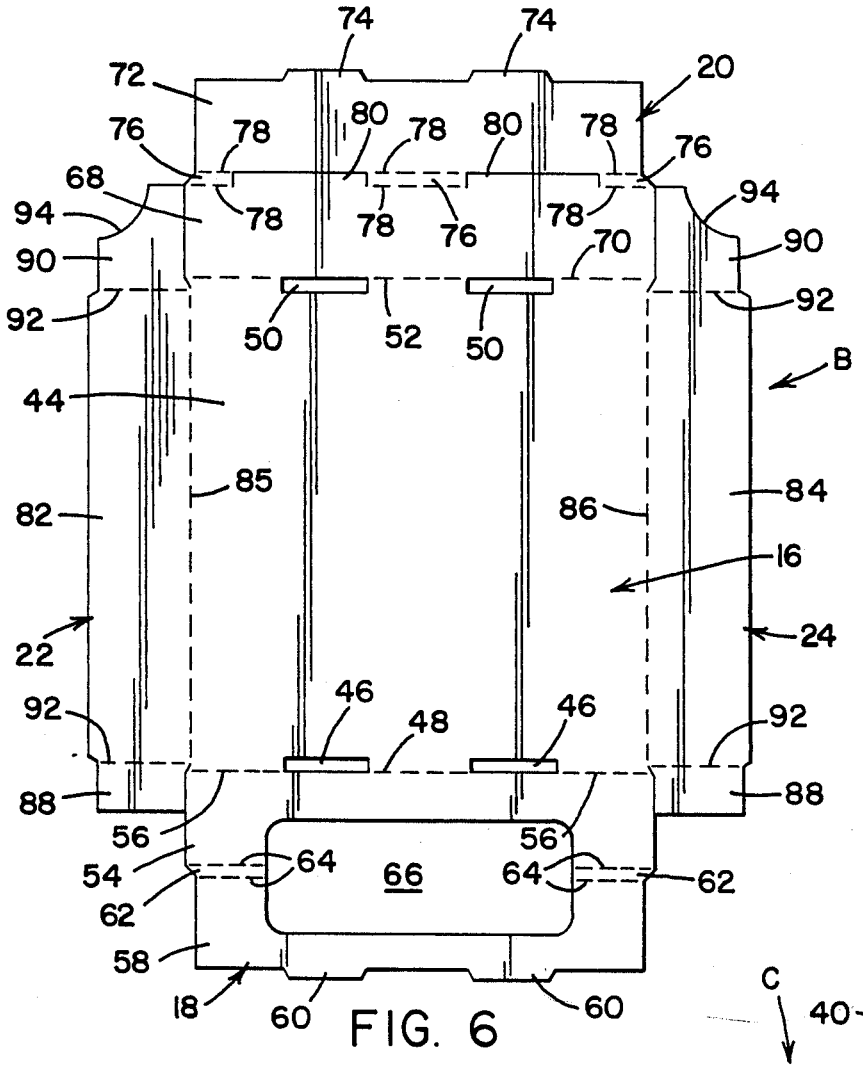
In FIG. 6 there is shown a top plan view of foldable paperboard blank form adapted in accordance with the present invention.

Referring now to FIG. 6, there is shown a paperboard blank form adapted to be foldably erected into the form of the tray 10. The blank form B includes a base panel 44 corresponding to the base panel 16 of the tray 10 and further includes a pair of forward slots 46 adjacent the forward edge 48 of the base panel 44, and a pair of rearward slots 50 adjacent the rearward edge 52. A first front panel member 54 is connected to the base panel 44 at a front folding line 56 coextensive with the forward edge 48 of the base panel 44. A second front panel member 58 includes forward tabs 60 adapted to register with forward slots 46 in base panel 44, and is connected to the first front panel member 54 by a front edge strip 62. The front edge strip 62 is defined by a pair of parallel folding front edge lines 64 which, as shown in the figure, are otherwise continuous with the front edge strip 62 longitudinally between the first front panel member 54 and the second front panel member 58 but for the presence of a generally rectangular void 66 disposed centrally of the two front panel members 54 and 58.

A first rear panel member 68 is connected to the base panel 44 along a rear folding line 70 coextensive with the rearward edge 52 of the base panel 44. A second rear panel member 72 includes rearward tabs 74 adapted to register with rearward slots 50 in the base panel 44, and is connected to the first rear panel member 68 by a rear edge strip 76 defined by a pair of parallel folding rear edge lines 78. The rear edge strip 76 is interrupted by a pair of projections 80 extending from the first rear panel member 68 towards the second rear panel member 72.

A pair of side panels 82 and 84 corresponding to side panels 22 and 24 of the tray 10 are connected to the base panel 44 along side folding lines 84 and 86, respectively. Each of the side panels 82 and 85 has a forward flap 88 and a rearward flap 90 connected thereto at flap folding lines 92. In the preferred embodiment the rearward flaps 90 include recessed edges 94 as shown in order to facilitate placement of the display panel 40 in a manner to be described hereinafter.

Figure 5:
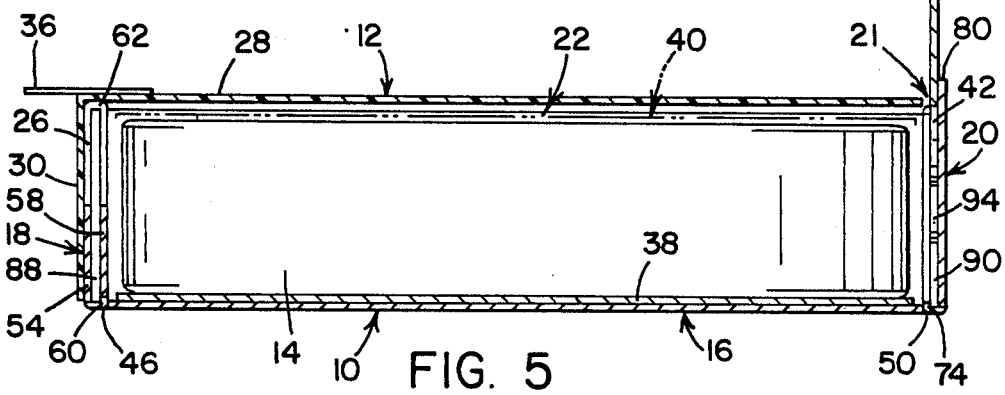
In FIG. 5 there is shown a cross sectional view of the appliance taken along line 5—5 of FIG. 2.

The blank form B is simply erected into the form of the tray 10. The second front panel member 58 is pivoted about the front edge strip 62 and the folding front edge lines 64 in order to bring the forward tabs 60 into positions adjacent the forward slots 46 in the base panel 44. Pivotal motion of the front panel members then brings the forward tabs 60 into engagement with the forward slots 44 whereby the front wall panel 18 of the tray 10 is erected in a vertical upright position as shown in FIG. 5. The front edge strip 62 defines the forward front edge of the tray 10, and the void 66 defines the upwardly open recess 26 in the front wall panel 18.

The first and second rear panel members 68 and 72 are similarly folded about appropriate folding lines to erect the rear wall panel 20 of the tray 10 in a vertical upright position as shown in FIG. 5. The rear edge strip 76 defines the rearward upper edge of the tray 10 as shown in FIG. 1, with the folding rear edge lines 78 and the projections 80 defining the display panel slots 21 as shown in FIG. 1.

Figure 3:
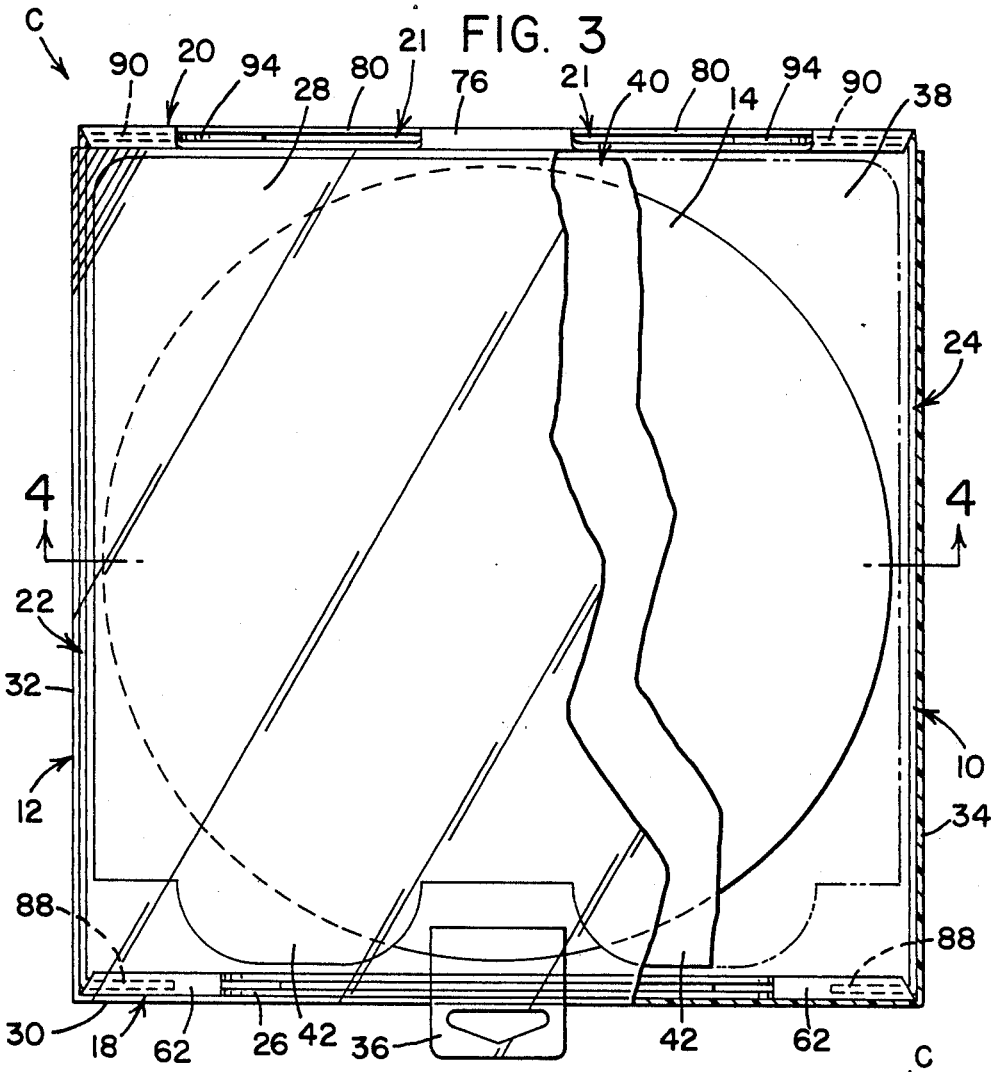
In FIG. 3 there is shown a top plan view of the appliance shown in FIG. 1.
Figure 4:
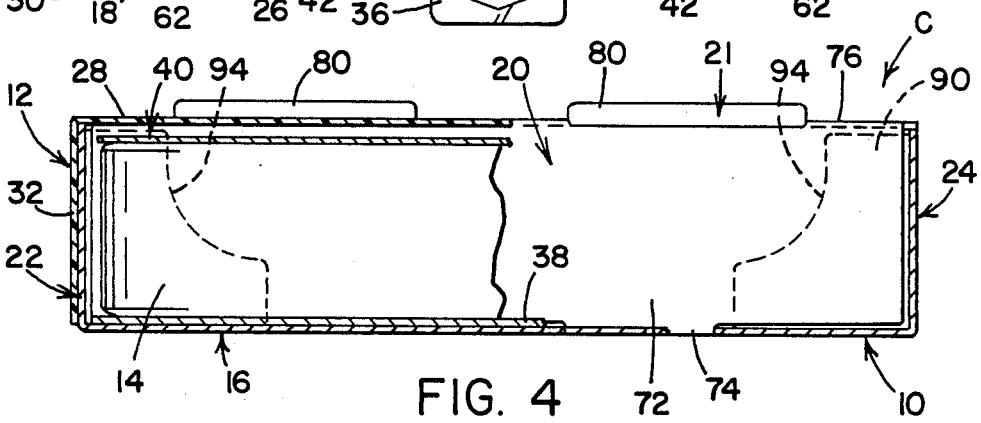
In FIG. 4 there is shown a cross sectional view of the appliance taken along line 4—4 of FIG. 3.

The side panels 82 and 84 are pivoted upwardly and inwardly about the side folding lines 85 and 86 and the forward and rearward flaps 88 and 90 are pivoted inwardly about the flap folding lines 92 whereupon the blank form B is fully erected into the tray 10 with the forward and rearward flaps 88 and 90 inserted between the first and second panel members of the front and rear walls 18 and 20 as shown in FIGS. 3 and 5. It is of course understood that no particular folding sequence is required to erect the blank form B into the tray 10 as shown.

Use of the container C is shown in FIGS. 1 and 2. The container is easily opened by merely sliding the plastic cover 12 across the front of the tray 10, either directly in a lateral direction as shown in FIG. 2, or with a component of lifting motion as desired, the advantageous feature of the invention being the ease with which the plastic cover 12 is removed and replaced without the necessity of vertically aligning the corners thereof with the four corners of the tray 10 as would be required by a conventional box. Persons using the container would not be reluctant to merely slide the cover back into place whereby freshness of the contained food product is more certainly assured over a long period of use. The display panel 40, which may be stored within the container C as shown in FIG. 1, is adapted to be mounted at the rear wall panel 20 of the tray 10 as shown with the display panel tabs 42 received in the display panel slots 21. The contained food product, such as cheese 14, may be reached directly from above or may more easily be reached with a spatula or other utensil through the upwardly open recess 26 formed in the front wall panel 18. A similar recess may of course be formed in either of the two side wall panels 22 or 24 in accordance with particular features of a food product which may call for access from one or more side locations. A particular feature of the invention is the fact that the container C, while providing access to and preserving the freshness of the contained food product, also serves as a storage container for remaining portions of the food product when closed in the position as shown in FIG. 1. Furthermore, the food support panel 38 may be disposable whereby the container would be reusable.

The invention has been described with reference to the preferred embodiment. Obviously modifications and alterations will occur to others upon the reading and understanding of this specification. It is intended to include all such modifications and alterations insofar as they come within the scope of the appended claims or the equivalence thereof.

Having thus described the invention, the following is claimed:

1. A food display and serving appliance comprising:

a tray having a rectangular base panel and four upwardly extending peripheral panels including a front panel, a rear panel, and two opposite side panels; and, a cover of clear plastic material closely receivable over said tray and having walls consisting of a rectangular top wall substantially coextensive with said base panel of said tray, and downwardly extending peripheral cover walls consisting of a front cover wall and two opposite side cover walls, said cover being receivable over said tray with said cover walls substantially coextensively overlying said front panel and said side panels, said cover being further comprised of a handle, said handle comprising a clear plastic tab adhesively fixed to said top wall at a position adjacent said front cover wall.

2. A food display and serving appliance comprising:

a tray having a rectangular base panel and four upwardly extending peripheral panels including a front panel, a rear panel, and two opposite side panels, said panels being of the same height and defining an unobstructed space therebetween; and, a cover closely receivable over and slidable along said tray and having walls consisting of a transparent rectangular top wall substantially coextensive with said base panel of said tray, and downwardly extending peripheral cover walls consisting of a front cover wall and two opposite side cover walls, said front panel of said tray having an upwardly open recess therein with a bottom edge extending substantially parallel throughout its full length to the plane of said tray base panel and along a major portion of the length of said front panel to provide unobstructed access through said recess into the said tray.

3. A food display and serving appliance comprising:

a tray having a rectangular base panel and four upwardly extending peripheral panels including a front panel, a rear panel, and two opposite side panels; and, a cover closely receivable over and slidable along said tray and having walls consisting of a transparent rectangular top wall substantially coextensive with said base panel of said tray, and downwardly extending peripheral cover walls consisting of a front cover wall and two opposite side cover walls;

said appliance further comprising a display panel loosely receivable and fully containable within said tray, said display panel having a lower edge and tab means associated with and protruding from said lower edge; and slot means associated with and formed in the top of said rear panel of said tray, said sot means being adapted to receive and cooperate with said tab means to mount said display panel on said rear panel in upstanding position thereon in a plane parallel thereto.

4. A combined food display and serving appliance comprising:

a cardboard blank form adapted to be folded about pivotable folding lines to erect a tray having a rectangular base panel and four upwardly extending peripheral panels, said blank form comprising a rectangular base panel having a front edge, a rear edge, two opposite side edges, first slot means associated with and parallel to said front edge, and second slot means associated with and parallel to said rear edge;

a pair of opposing elongated rectangular side panels connected to said base panel at a pair of pivotal side folding lines coextensive with said two opposite side edges;

flap members including a flap member connected to each longitudinal end of each of said elongated rectangular side panels at a pivotal flap folding line;

an elongated rectangular front panel connected to said base panel at a pivotal front folding line extending along and coextensive with said front edge of said base panel, said front panel having a free longitudinal edge parallel to said front folding line, a pair of longitudinally extending closely spaces side-by-side first internal folding lines substantially bisecting and forming said front panel into first and second front panel members connected by narrow front edge strip means, and first tab means at said free longitudinal edge, said front panel being adapted to be folded along said front folding line and along said pair of first internal folding lines, with said first tab means being adapted to register with and be inserted into said first slot means in an interlocking relationship, to form said front panel into double wall form with said first and second front panel members spaced apart to form a first narrow slot-shaped passageway therebetween;

a rectangular rear panel connected to said base panel at a pivotal rear folding line extending along and substantially coextensive with said rear edge of said base panel, said rear panel having a free longitudinal edge parallel to said rear folding line, a pair of longitudinally extending closely spaced side-by-side second internal folding lines substantially bisecting and forming said rear panel into first and second rear panel members connected by narrow rear edge strip means, and second tab means associated with said free longitudinal edge of said rear panel, said rear panel being adapted to be folded along said rear folding line and along said par of second internal folding lines, with said second tab means being adapted to register with and be inserted into said second slot means in an interlocking relationship, to form said rear panel into double wall form with said first and second rear panel members spaced apart to form a second narrow slot-shaped passageway therebetween;

said flap members being adapted to be folded inwardly at their respective said pivotal flap folding lines for insertion into the adjacent open ends of the said first and second slot-shaped passageways between the said front panel members and between the said rear panel members to connect the said side panels to said front and rear panels; and, a transparent cover member having a rectangular top wall substantially coextensive with said base panel of said cardboard blank form, and cover wall s consisting of a rectangular front cover wall and two opposite side cover walls.

5. A combined food display and serving appliance as defined in claim 4 further comprising a display panel having a lower edge and third tab means associated with said lower edge; and, third slot means associated with said second internal folding lines and being adapted to register with said third tab means on said display panel.

6. A combined food display and serving appliance as defined in claim 4, wherein said elongated rectangular front panel of said cardboard blank form is provided with a corresponding elongated rectangular aperture disposed centrally of the two said front panel members to form, on said folding of said front panel along said pair of front internal folding lines, an elongated upwardly open recess in said folded double wall from front panel.

7. A food display and serving appliance comprising:

a tray having a rectangular base panel and four upwardly extending peripheral panels including a front panel, a rear panel, and two opposite side panels; and, a cover closely receivable over said tray and comprising a transparent rectangular top wall substantially coextensive with said base panel of said tray, and downwardly extending peripheral cover walls consisting of a front cover wall and tow opposite side cover walls;

said cover is receivable over said tray with said cover wall ssubstnatially coextensively overlying said front panel and said side panels;

said cover is comprises of a clear plastic material; and said cover further comprises a handle, said handle comprising a clear plastic tab adhesively fixed to said top wall at a position adjacent said front cover wall.

8. A combined food display and serving appliance comprising:

a cardboard blank form adapted to be folded about pivotal folding lines to erect a tray having a rectangular base panel and four upwardly extending peripheral panels, said blank form comprising a rectangular base panel having a front edge, a rear edge, two opposite side edges, first slot means associated with said front edge, and second slot means associated with said rear edge;

a pair of opposing elongated rectangular side panels connected to said base panel at a pair of pivotal side folding lines coextensive with said two opposite side edges;

flap members including a flap member connected to each longitudinal end of each of said elongated rectangular side panels at a pivotal flat folding line;

an elongated rectangular front panel connected to said base panel at a pivotal front folding line coextensive with said front edge of said base panel, said front panel having a free longitudinal edge parallel to said front folding line, a pair of longitudinally extending first internal folding lines substantially bisecting said front panel, and first tab means at said free longitudinal edge, said first tab means being adapted to register with said first slot means in an interlocking relationship;

a rectangular rear panel connected to said base panel at a pivotal rear folding line substantially coextensive with said rear edge of said base panel, said rear panel having a free longitudinal edge parallel to said rear folding line, a pair of longitudinally extending second internal folding lines substantially bisecting said rear panel, and second tab means associated with said free longitudinal edge and adapted to register with said second slot means in an interlocking relationship;

a transparent cover member having a rectangular top wall substantially coextensive with said base panel of said cardboard blank form, and cover walls consisting of a rectangular front cover wall and two opposite side cover walls; and said transparent cover member is made of a plastic material, and further includes a handle int he form of a clear plastic tab adhesively fixed to said top wall at a position adjacent said front cover wall.

9. A combined food display and serving appliance comprising:

a cardboard blank form adapted to be folded about pivotal folding lines to erect a tray having a rectangular base panel and four upwardly extending peripheral panels, said blank form comprising a rectangular base panel having a front edge, a rear edge, two opposite side edges, first slot means associated with said front edge, and second slot means associated with said rear edge;

a pair of opposing elongated rectangular side panels connected to said base panel at a pair of pivotal side folding lines coextensive with said two opposite side edges;

flap members including a flap member connected to each longitudinal end of each of said elongated rectangular side panels at a pivotal flap folding line;

an elongated rectangular front panel connected to said base panel at a pivotal front folding line coextensive with said front edge of said base panel, said front panel having a free longitudinal edge parallel to said front folding line, a pair of longitudinally extending first internal folding liens substantially bisecting said front panel, and first tab means adapted to register with said first slot means in an interlocking relationship;

a rectangular rear panel connected to said base panel at a pivotal rear folding line substantially coextensive with said rear edge of said base panel, said rear panel having a free longitudinal edge parallel to said rear folding line, a pair of longitudinally extending second internal folding liens substantially bisecting said rear panel, and second tab means associated with said free longitudinal edge and adapted to register with said second slot means in an interlocking relationship;

a transparent cover member having a rectangular top wall substantially coextensive with said base panel of said cardboard blank form, and cover walls consisting of a rectangular front cover wall and two opposite side cover walls; and said internal folding line in said front panel is interrupted by a longitudinally elongated generally rectangular void in said front panel, said void being disposed substantially centrally of said front panel.

10. A food display and serving appliance comprising:

a tray having a rectangular base panel and four upwardly extending peripheral panels including a front panel, a rear panel, and tow opposite side panels; and a cover closely receivable cover and slidable along said tray and having walls consisting of a transparent rectangular top wall substantially coextensive with said base panel of said tray and downwardly extending peripheral cover walls consisting of a front cover wall and two opposite side cover walls;

said rear panel of said tray being comprises of two closely spaced rear panel members joined at their top edges by narrow top connector strip means provided with a spaced pair of aligned slot-shape apertures for receiving tab extensions of a display panel to mount it on said rear panel in upstanding position on said tray, the rearmost one of said rear panel members having projections extending upwardly beyond the said connector strip means of said rear panel and coextensive with the said slot shape apertures therein to engage and further support the said display panel in said upstanding position.

* * * * *